US006254039B1

(12) United States Patent
Zimmerman

(10) Patent No.: US 6,254,039 B1
(45) **Date of Patent: *Jul. 3, 2001**

(54) GUTTER HANGING BRACKET DEVICE WITH RIGIDITY AUGMENTING U-SHAPED CROSS-SECTIONAL CHANNEL CONSTRUCTION

(76) Inventor: Raymond G. Zimmerman, 2504 Division Hwy., Ephrata, PA (US) 17522-9310

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/223,409

(22) Filed: Dec. 30, 1998

(51) Int. Cl.[7] ..... E04D 13/072

(52) U.S. Cl. ..... 248/48.2; 248/903; 248/48.1; 52/11; 52/13

(58) Field of Search ..... 52/11, 13, 15, 52/12, 16, 95, 96, 94, 56, 90; 248/903, 18.1, 48.2, 216.1, 547, 71

(56) References Cited

U.S. PATENT DOCUMENTS

| | | | | |
|---|---|---|---|---|
| 2,534,739 | * | 12/1950 | Silberman | 248/48.2 |
| 2,654,555 | * | 10/1953 | Rachlin | 248/48.1 |
| 2,710,159 | * | 6/1955 | Gordon | 52/11 |
| 3,053,491 | | 9/1962 | Ramser | 248/48.2 |
| 3,295,803 | | 1/1967 | Blayden | 248/48.2 |
| 3,296,749 | * | 1/1967 | Cotter | 248/48.2 |
| 3,333,803 | | 8/1967 | Landis | 248/48.2 |
| 3,416,760 | | 12/1968 | Sauder | 248/48.2 |
| 3,436,878 | * | 4/1969 | Singer | 248/48.2 |
| 3,737,127 | | 6/1973 | Maloney, Jr. et al. | 248/48.2 |
| 3,752,428 | * | 8/1973 | Trostle et al. | 248/48.2 |
| 4,043,527 | * | 8/1977 | Franzmeier | 248/48.2 |
| 4,169,570 | | 10/1979 | Movin | 248/48.2 |
| 4,210,301 | | 7/1980 | Weiss | 248/48.2 |
| 4,241,548 | | 12/1980 | Rowe | 52/11 |
| 4,294,422 | | 10/1981 | Odekirk | 248/48.2 |
| 4,345,731 | | 8/1982 | Rowe | 248/48.2 |
| 5,004,191 | | 4/1991 | Cokky | 248/48.2 |
| 5,271,192 | | 12/1993 | Nothum, Sr. et al. | 52/12 |
| 5,884,876 | * | 3/1999 | Axford | 248/48.2 |

OTHER PUBLICATIONS

Publication entitled "High Quality Durable Rain Gutter Products" by Trademan's Choice of Lomita, California.

* cited by examiner

*Primary Examiner*—Ramon O. Ramirez
*Assistant Examiner*—Kimberly T. Wood
(74) *Attorney, Agent, or Firm*—Michael R. Swartz; John R. Flanagan

(57) ABSTRACT

A gutter hanging bracket device includes an elongated body portion adapted to span an open top of a gutter between front and rear sides of the gutter and having a generally U-shaped cross-sectional channel construction, a forward attachment portion merging from a front end of the body portion and adapted to engage with the front side of the gutter, and a rearward attachment portion merging from a rear end of the body portion and adapted for attaching the rear side of the gutter to an adjacent external structure so as to support the body portion in a cantilevered fashion from the external structure and thereby hang the gutter adjacent to the external structure. The forward and rearward attachment portions form extensions of the body member such that the forward and rearward attachment portions both have generally U-shaped cross-sectional channel constructions continuous with that of the body portion.

10 Claims, 2 Drawing Sheets

GUTTER HANGING BRACKET DEVICE WITH RIGIDITY AUGMENTING U-SHAPED CROSS-SECTIONAL CHANNEL CONSTRUCTION

BACKGROUND OF THE INVENTION

1. Field of the Invention

The present invention generally relates to devices for hanging gutters and, more particularly, is concerned with a gutter hanging bracket device with a rigidity augmenting or bolstering U-shaped cross-sectional channel construction.

2. Description of the Prior Art

A building, such as a residential house, may have one or more gutters disposed along the lower edge of a roof thereof. The gutters are typically attached to an upper portion or facia board of an exterior wall of the building by suitable means just below the lower edge of the roof. One attachment means, known as a nail/ferrule attachment, has been used for many years to hang gutters. The nail/ferrule attachment is considered one of the strongest types of gutter hanging devices. A problem exists, however, with the nail/ferrule attachment in that it requires more labor and, particularly, more skilled labor than other types of attachment means because the nails must be driven accurately otherwise the gutter can be dented which would require its replacement.

In more recent years, attachment means known as "hidden" hangers have been used to hang gutters. A hidden hanger is generally attached to the fascia board by screws installed by a portable drill or automatic screw gun. The hidden hanger minimizes the amount of labor required to hang the gutter, though the hidden hanger is typically not as strong as the conventional nail/ferrule attachment. A variety of hidden gutter hanger devices have been developed over the years.

Representative examples of prior art gutter hanger devices and the like are disclosed in U.S. Pat. Nos. 3,053,491 to Ramser, 3,295,803 to Blayden, 3,333,803 to Landis, 3,416,760 to Sauder, 3,737,127 to Maloney, Jr. et al., 4,169,570 to Morin, 4,210,301 to Weiss, 4,241,548 to Rowe, 4,294,422 to Odekirk, 4,345,731 to Rowe, 5,004,191 to Corry and 5,271,192 to Nothum, Sr. et al. These prior art gutter hanger devices appear to be satisfactory in use for the specific purposes for which they were designed. A problem exists, however, with many prior art hidden gutter hanger devices in that they are generally weak and tend to bend, such as from the weight of ice and/or snow. Bent hanger devices are unsightly in their bent condition. A gutter with a bent hanger may also snap out of the hanger device and fall from the roof.

Consequently, a need still exists for a device which provides a solution to the aforementioned prior art problems without introducing any new problems in place thereof.

SUMMARY OF THE INVENTION

The present invention provides a gutter hanging bracket device designed to satisfy the aforementioned need. The gutter hanging bracket device of the present invention has a U-shaped cross-sectional channel construction that bolsters or augments the rigidity of the device over that of the prior art so that the device does not bend significantly under normal conditions. The gutter hanging bracket device is as strong as conventional nail/ferrule attachments but can be fastened with a minimum amount of labor and, particularly, with less skilled labor, without fear of damage to the gutter.

Accordingly, the present invention is directed to a gutter hanging bracket device which comprises: (a) an elongated body portion adapted to span an open top of a gutter between front and rear sides of the gutter and having opposite front and rear ends and a generally U-shaped cross-sectional channel construction; (b) a forward attachment portion merging from the front end of the body portion and adapted to engage with the front side of the gutter; and (c) a rearward attachment portion merging from the rear end of the body portion and adapted to attach the rear side of the gutter to an adjacent external structure so as to support the body portion in a cantilevered fashion from the external structure and thereby hang the gutter adjacent to the external structure. The forward and rearward attachment portions form extensions of the body member such that the forward and rearward attachment portions both have generally U-shaped cross-sectional channel constructions continuous with that of the body portion.

Further, the elongated body portion has a main base wall and a pair of opposite main side walls. The main base wall has a pair of laterally spaced longitudinal edges extending between the front and rear ends of the body portion. The main side walls extend between the front and rear ends of the body portion and are attached along the longitudinal edges of the main base wall and extend upwardly therefrom such that the body portion has a generally U-shaped cross-sectional channel construction being continuous between the front and rear ends thereof.

The forward attachment portion includes a forward end wall and a pair of opposite forward side walls. The forward end wall has laterally spaced longitudinal edges. The forward side walls are attached along the longitudinal edges of the forward end wall and extend outwardly therefrom. The forward end wall and forward side walls of the forward attachment portion merge from and form extensions of the main base wall and main side walls of the body portion such that the forward attachment portion has a generally U-shaped cross-sectional channel construction being continuous with that of the body portion.

The rearward attachment portion includes a rearward end wall and a pair of opposite rearward side walls. The rearward end wall has laterally spaced longitudinal edges and extends upwardly from the rear end of the main base portion of the body portion. The rearward side walls are attached along the longitudinal edges of the rearward end wall and extend outwardly therefrom. The rearward end wall and rearward side walls of the rearward attachment portion merge from and form extensions of the main base wall and main side walls of the body portion such that the rearward attachment portion has a generally U-shaped cross-sectional channel construction being continuous with that of the body portion.

More particularly, the main base wall of the body portion has a width extending between the longitudinal edges thereof that is greater than a height of each of the main side walls of the body portion extending upwardly from the longitudinal edges of the main base wall. The main base wall of the body portion also has a substantially planar configuration. The main base wall of the body portion further has at least one aperture defined therethrough for attaching an end of a roof strap thereto.

The forward attachment portion is in the form of a hook having an arcuate configuration curving upwardly from the main base portion and rearwardly toward the rear end of the body portion. Specifically, the forward attachment portion has a generally C-shaped configuration adapted to be captured under a rearwardly extending ledge on the front side of the gutter.

The rearward end wall of the rearward attachment portion has at least one hole defined therethrough for receiving a fastener to attach the rearward attachment portion and the rear side of the gutter to the external structure. The rearward attachment portion can be in the form of a clip wherein the rearward attachment portion includes a rear leg merging from an upper end of the rearward end wall and being spaced from and extending downwardly and generally parallel to the rearward end wall so as to form the clip with an inverted generally U-shaped configuration defining a slot between the rear leg and rearward end wall being open at a bottom of the clip for receiving the rear side of the gutter therein. The rear leg and rearward end wall of the rearward attachment portion have aligned holes defined therethrough for receiving a fastener to attach the rearward attachment portion and the rear side of the gutter to the external structure.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
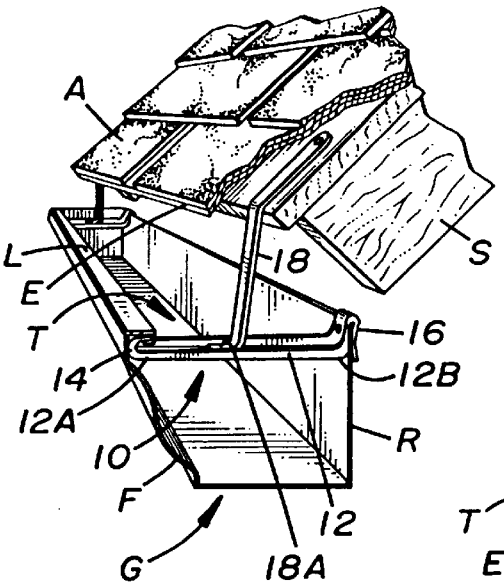
FIG. 1 is a perspective view of a first embodiment of a gutter hanging bracket device of the present invention shown employed with a roof strap for hanging a gutter adjacent to an edge of the roof.

In the following description, like reference characters designate like or corresponding parts throughout the several views of the drawings. Also in the following description, it is to be understood that such terms as "forward", "rearward", "upwardly", "downwardly", and the like are meant to be words of convenience and are not to be construed as limiting terms.

Figure 2:
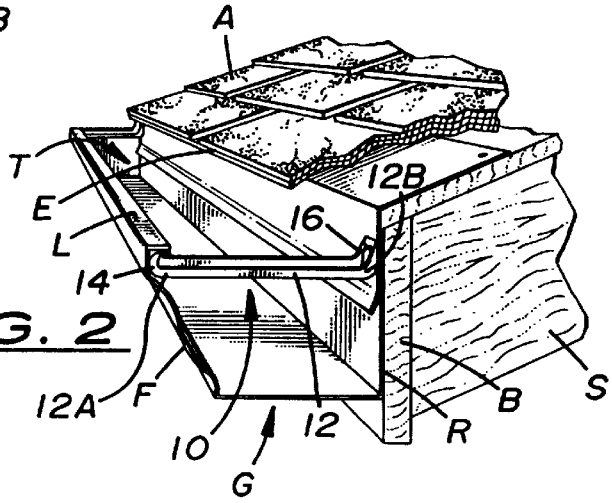
FIG. 2 is a perspective view of a second embodiment of the gutter hanging bracket device of the present invention shown hanging the gutter adjacent to the roof edge.
Figure 3:
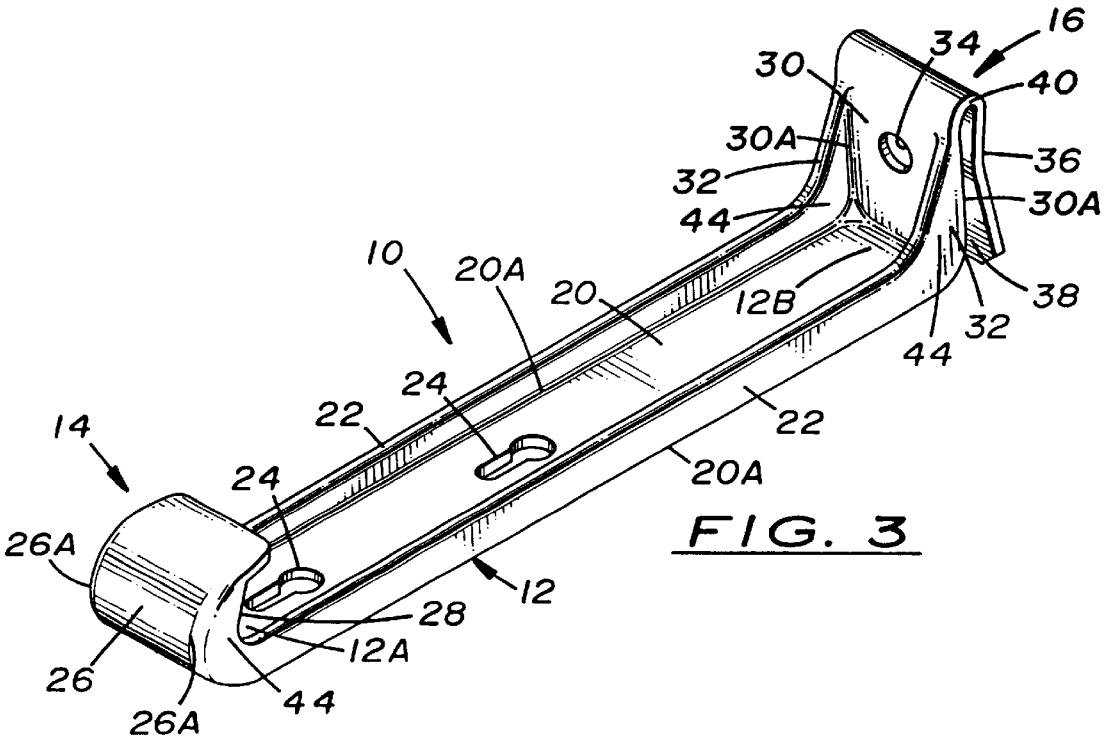
FIG. 3 is an enlarged perspective view of the first embodiment of the gutter hanging bracket device of FIG. 1.
Figure 4:
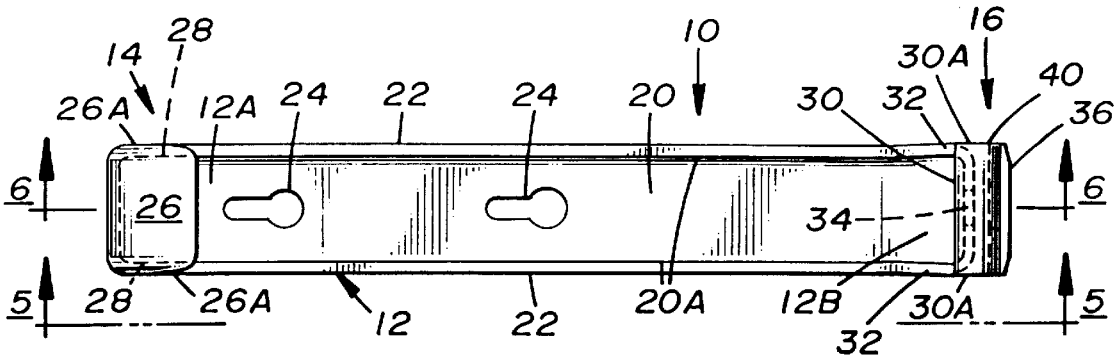
FIG. 4 is a top plan view of the device of FIG. 3.
Figure 5:
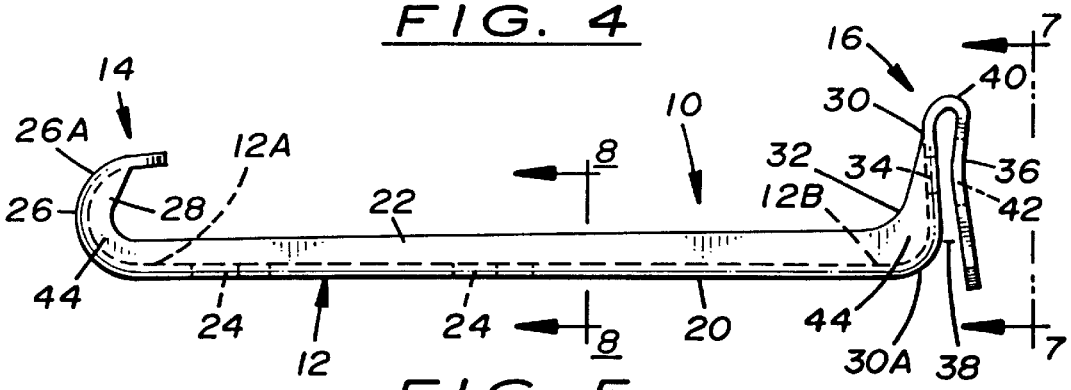
FIG. 5 is a side elevational view of the device as seen along line 5—5 of FIG. 4.
Figure 6:
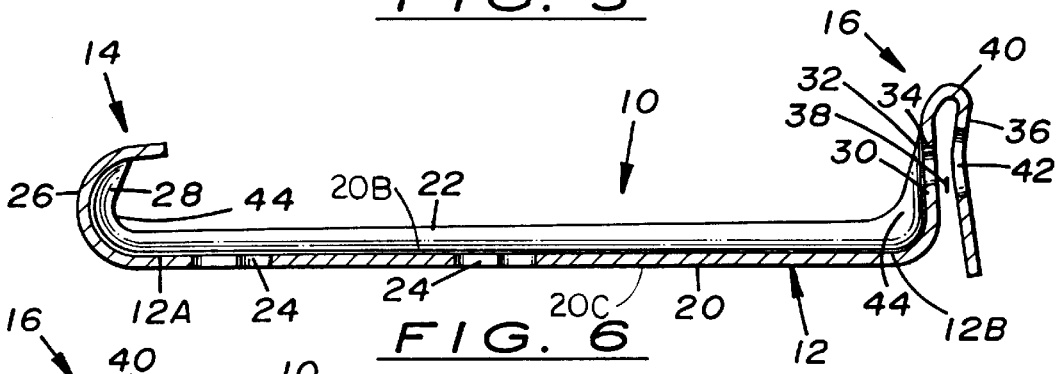
FIG. 6 is a longitudinal sectional view of the device taken along line 6—6 of FIG. 4.
Figure 7:
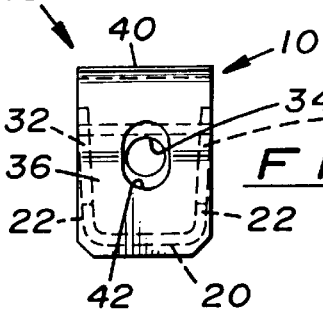
FIG. 7 is an end elevational view of the device as seen along line 7—7 of FIG. 5.
Figure 8:
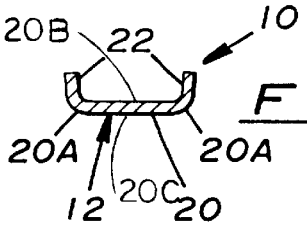
FIG. 8 is a cross-sectional view of the device taken along line 8—8 of FIG. 5.
Figure 9:
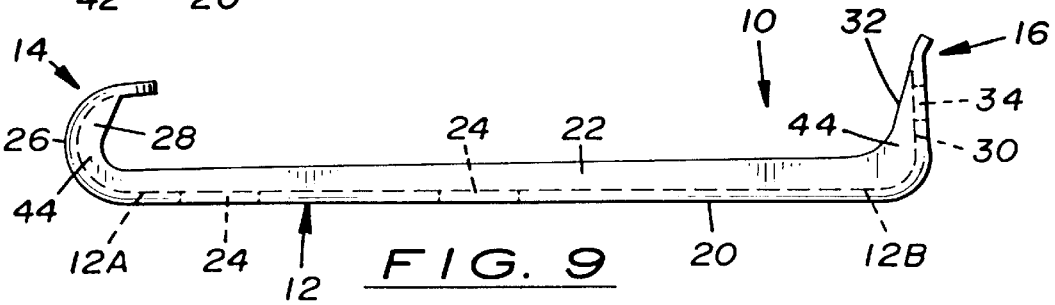
FIG. 9 is an enlarged side elevational view of the second embodiment of the device of FIG. 2.

Referring to the drawings and particularly to FIGS. 1 to 2, there is illustrated a gutter hanging bracket device, generally designated 10, of the present invention, being shown hanging a gutter G below an edge E of a roof A. The gutter hanging bracket device 10 may have either of two embodiments. A first embodiment of the device 10 is shown in FIGS. 1 and 3 to 8 while a second embodiment of the device 10 is shown in FIGS. 2 and 9. In both embodiments, the device 10 basically includes an elongated body portion 12, a forward attachment portion 14 and a rearward attachment portion 16. The body portion 12 is adapted to span an open top T of the gutter G between front and rear sides F, R of the gutter G and has opposite front and rear ends 12A, 12B and a generally U-shaped cross-sectional channel construction, as best seen in FIGS. 3 and 8. The forward attachment portion 14 merges from the front end 12A of the body portion 12 and is adapted to engage with the front side F of the gutter G. The rearward attachment portion 16 merges from the rear end 12B of the body portion 12 and is adapted for attaching the rear side R of the gutter G to an adjacent external structure, such as a building S, so as to support the body portion 12 in a cantilevered fashion from the building S and thereby hang the gutter G adjacent to the building S and below the edge E of the roof A. The forward and rearward attachment portions 14, 16 form extensions of the body portion 12 such that the forward and rearward attachment portions 14, 16 both have generally U-shaped cross-sectional channel constructions continuous with that of the body portion 12. The device 10 also can include a roof strap 18 adapted to secure the elongated body portion 12 and thereby the gutter G to the roof A, as shown in FIG. 1. In FIG. 2, the device 10 and the gutter G thereof are attached to a fascia board B of the building S.

Referring to FIGS. 1 to 9, in both embodiments of the device 10, the body portion 12 has a main base wall 20 and a pair of opposite main side walls 22. The main base wall 20 has a pair of laterally spaced longitudinal edges 20A, and upper and lower faces 20B, 20C; extending between the front and rear ends 12A, 12B of the body portion 12. The main side walls 22 extend between the front and rear ends 12A, 12B of the body portion 12 and are attached along the longitudinal edges 20A of the main base wall 20 and extend upwardly from the upper face 20B of the main base wall 20 away from the open top T of the gutter G such that the generally U-shaped cross-sectional channel construction of the body portion 12 is located above the lower face 20C of the main continuous between the front and rear ends 12A, 12B thereof. Preferably but not necessarily, the main side walls 22 extend substantially parallel to one another and perpendicular to the main base wall 20.

More particularly, the main base wall 20 of the body portion 12 has a width extending between the longitudinal edges 20A thereof that is substantially less than a length thereof extending between the front and rear ends 12A, 12B of the body portion 12. Also, the width of the main base wall 20 of the body portion 12 is greater than the height of each main side wall 22 of the body portion 12 extending upwardly from the longitudinal edges 20A of the main base wall 20. The main base wall 20 also has a substantially planar configuration and at least one and preferably a pair of spaced apertures 24 defined through the main base wall 20 for attaching an end 18A of the roof strap 18 thereto.

In both embodiments of the device 10, the forward attachment portion 14 includes a forward end wall 26 and a pair of opposite forward side walls 28. The forward end wall 26 has laterally spaced longitudinal edges 26A. The forward side walls 28 are attached along the longitudinal edges 26A of the forward end wall 26 and extend outwardly therefrom and above the upper face 20B of the main base wall 20. Preferably but not necessarily, the forward side walls 28 extend substantially parallel to one another and perpendicular to the forward end walls 26. The forward end wall 26 has a length substantially less than the length of the main base wall 20 and a width substantially the same as the width of the main base wall 20. Further, the width of the forward end wall 26 of the forward attachment portion 14 extending between the longitudinal edges 26A thereof is greater than the height of each forward side wall 28 thereof extending outwardly from the longitudinal edges 26A of the forward end wall 26. The forward end wall 26 and forward side walls 28 of the forward attachment portion 14 merge from and form extensions of the main base wall 20 and main side walls 22 of the body portion 12 such that the forward attachment portion 14 has a generally U-shaped cross-sectional channel construction continuous with that of the body portion 12.

More particularly, the forward attachment portion 14 is in the form of a hook having an arcuate configuration curving upwardly from the main base wall 20 and rearwardly toward the rear end 12B of the body portion 12. The forward attachment portion 14 has a generally C-shaped configuration adapted to be captured under a rearwardly extending ledge L on the front side F of the gutter G.

Further, in both embodiments of the device 10, the rearward attachment portion 16 includes a rearward end wall 30 and a pair of opposite rearward side walls 32. The rearward end wall 30 has laterally spaced longitudinal edges 30A and extends upwardly, preferably at a right angle, from the main base wall 20 at the rear end 12B of the body portion 12. The rearward side walls 32 are attached along the longitudinal edges 30A of the rearward end wall 30 and extend outwardly therefrom and above the upper face 20B of the main base wall 20. Preferably but not necessarily, the rearward side walls 32 extend substantially parallel to one another and perpendicular to the rearward end wall 30. The rearward end wall 30 has a length substantially less than the length of the main base wall 20 and a width substantially the same as the widths of the main base wall 20 and forward end wall 26. The width of the rearward end wall 30 of the rearward attachment portion 16 extending between the longitudinal edges 30A thereof is greater than the height of each rearward side wall 32 thereof extending outwardly from the longitudinal edges 30A of the rearward end wall 30. The rearward end wall 30 and rearward side walls 32 of the rearward attachment portion 16 merge from and form extensions of the main base wall 20 and main side walls 22 of the body portion 12 such that the rearward attachment portion 16 has a generally U-shaped cross-sectional channel construction continuous with that of the body portion 12. The rearward end wall 30 of the rearward attachment portion 16 also has a hole 34 defined therethrough for receiving a fastener (not shown) to attach the rearward attachment portion 16 and the rear side R of the gutter G to the building B.

The rearward attachment portion 16 in the second embodiment of the device 10 shown in FIGS. 2 and 9 has only the rearward end wall 30 as described above. In the first embodiment of the device 10 shown in FIGS. 1 and 3 to 8, the rearward attachment portion 16 takes the form of a clip wherein the rearward attachment portion 16 also includes a rear leg 36 merging from an upper end of the rearward end wall 30 and being spaced from and extending downwardly and generally parallel to the rearward end wall 30 so as to form the clip with an inverted generally U-shaped configuration defining a slot 38 between the rear leg 36 and rearward end wall 30. The top of the clip is closed by a bight 40 that interconnects the rear leg 38 to the upper end of the rearward end wall 30. The slot 38 is open at a bottom of the clip for receiving the rear side R of the gutter G therein. The rear leg 36 has a hole 42 defined therethrough which is aligned with the hole 34 defined through the rearward end wall 30. The aligned holes 42, 34 are provided for receiving a fastener (not shown) to attach the rearward attachment portion 16 of the device 10 and the rear side R of the gutter G to the building S. Thus, from the above description of the device 10, it will be understood that the first and second embodiments of the device 10 are substantially the same, except for the rearward attachment portion 16 of the device 10.

In both embodiments of the device 10, the continuous U-shaped cross-sectional channel constructions, being continuous from the front and rear ends 12A, 12B of the elongated body portion 12 of the device 10 into the forward and rearward attachment portions 14, 16 thereof, define substantially, coplanar web-like segments 44 at the location of merger of the main side walls 22 with the forward and rearward side walls 28, 32. The web-like segments 44 are integral with and bridge the main side walls 22 of the body portion 12 with the respective side walls 28, 32 of the forward and rearward attachment portions 14, 16. Each forward side wall 28 of the forward attachment portion 14 tapers toward and merges or blends into the forward end wall 26 before reaching the terminal end of the forward attachment portion 14. Similarly, each rearward side wall 32 of the rearward attachment portion 16 tapers toward and merges or blends into the rearward end wall 30 before reaching the terminal end of the rearward attachment portion 16. These web-like segments 44 formed at the merger of the forward and rearward attachment portions 14, 16 with the respective front and rear ends 12A, 12B of the body portion 12 optimize the rigidity and thereby provide additional strength to the gutter hanging bracket device 10. Preferably, the web-like segments 44 formed at the merger of the rearward attachment portion 16 with the rear end 12B of the main body portion 12 is of maximum height which is greater than the height of the main side walls 22 and the rear side walls 32 that form the web-like segments 44 at this merger location.

The bracket device 10 is constructed by conventional cold forming techniques and is preferably formed from a continuous blank of sheet metal.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

What is claimed is:

1. A gutter hanging bracket device, comprising:

(a) an elongated body portion adapted to span an open top of a gutter between front and rear sides of the gutter, said body portion having opposite front and rear ends and including a main base wall and a pair of opposite main side walls, said main base wall having a substantially planar configuration and upper and lower faces and a pair of laterally spaced longitudinal edges extending between said front and rear ends of said body portion, said main side walls extending between said front and rear ends of said body portion and being attached along said longitudinal edges of said main base wall and extending upwardly from said upper face of said main base wall away from said open top of said gutter such that said body portion has a generally U-shaped cross-sectional channel construction located above said lower face of said main base wall and being continuous between said front and rear ends thereof, said main base wall having a width extending between said longitudinal edges thereof being greater than a height of each of said main side walls extending upwardly from said longitudinal edges of said main base wall;

(b) a forward attachment portion merging from said front end of said body portion and adapted to engage with the front side of the gutter, said forward attachment portion curving upwardly from said upper face of said main base wall of said body portion and rearwardly toward said rear end of said body portion, said forward attachment portion including a forward end wall and a pair of opposite upstanding forward sidewalls, said forward end wall having laterally spaced longitudinal edges and an arcuate configuration curving upwardly from said main base portion of said body portion and rearwardly toward said rear end of said body portion, said forward side walls being attached along said longitudinal edges of said forward end wall and extending outwardly therefrom toward said rear end of said body portion and above said upper face of said main base wall, said forward end wall and forward side walls of said forward attachment portion merging from and forming extensions of said main base wall and main side walls of said body portion such that said forward attachment portion has a generally U-shaped cross-sectional channel construction being continuous with and disposed above that of said body portion;

(c) a rearward attachment portion merging from said rear end of said body portion and extending upwardly from said upper face of said main base wall and adapted to attach the rear side of the gutter to an adjacent external structure so as to support said body portion in a cantilevered fashion from the external structure and thereby hang the gutter adjacent to the external structure, said attachment portion including a rearward end wall and a pair of opposite upstanding rearward side walls, said rearward end wall having laterally spaced longitudinal edges and extending upwardly from said rear end of said main base portion of said body portion, said rearward side walls being attached along said longitudinal edges of said rearward end wall and extending outwardly therefrom toward said front end of said body portion and above said upper face of said main base wall, said rearward end wall and rearward side walls of said rearward attachment portion merging from and forming extensions of said main base wall and main side walls of said body portion such that said rearward attachment portion has a generally U-shaped cross-sectional channel construction being continuous with and disposed above that of said body portion; and (d) web segments formed integrally with and bridging said main side walls of said body portion with said respective side walls of said forward and rearward attachment portions, said web segments bridging said main side walls with said sidewalls of said rearward attachment portion being coplanar with said main side walls and with said side walls of said rearward attachment portion and of maximum height which is greater than the height of said main side walls of said main body portion and greater than the height of said side walls of said rearward attachment portion.

2. The device as recited in claim 1, wherein said main base wall of said body portion has a width extending between said longitudinal edges thereof being greater than a height of each of said main side walls of said body portion extending upwardly from said longitudinal edges of said main base wall.

3. The device as recited in claim 1, wherein said main base wall of said body portion has a substantially planar configuration.

4. The device as recited in claim 1, wherein said forward attachment portion is in the form of a hook having an arcuate configuration curving upwardly from said main base wall and rearwardly toward said rear end of said body portion.

5. The device as recited in claim 1, wherein said main base wall of said body portion has at least one aperture defined therethrough for attaching an end of a roof strap thereto.

6. The device as recited in claim 1, wherein said forward attachment portion has a generally C-shaped configuration adapted to be captured under a rearwardly extending ledge on the front side of the gutter.

7. The device as recited in claim 1, wherein said rearward end wall of said rearward attachment portion has at least one hole defined therethrough for receiving a fastener to attach said rearward attachment portion and the rear side of the gutter to the external structure.

8. The device as recited in claim 1, wherein said rearward attachment portion is in the form of a clip.

9. The device as recited in claim 8, wherein said rearward attachment portion includes a rear leg merging from an upper end of said rearward end wall and being spaced from and extending downwardly and generally parallel to said rearward end wall so as to form said clip with an inverted generally U-shaped configuration defining a slot between said rear leg and rearward end wall being open at a bottom of said clip for receiving the rear side of the gutter therein.

10. The device as recited in claim 9, wherein said rear leg and rearward end wall of said rearward attachment portion have aligned holes defined therethrough for receiving a fastener to attach said rearward attachment portion and the rear side of the gutter to the external structure.

* * * * *